US005395246A

United States Patent [19]

Punako et al.

[11] Patent Number: 5,395,246

[45] Date of Patent: Mar. 7, 1995

[54] CONNECTOR HAVING MULTIPLE KEYING FEATURES

[75] Inventors: Stephen Punako; Norman A. Hayner, both of Bainbridge, N.Y.

[73] Assignee: Amphenol Corporation, Wallingford, Conn.

[21] Appl. No.: 70,300

[22] Filed: Jun. 2, 1993

[51] Int. Cl.[6] ..... H01R 13/64

[52] U.S. Cl. ..... 439/680; 403/405.1

[58] Field of Search ..... 439/677, 680, 681; 403/13, 14, 405.1

[56] References Cited

U.S. PATENT DOCUMENTS

| | | | |
|---|---|---|---|
| 4,229,064 | 10/1980 | Vetter et al. . | |
| 4,423,919 | 1/1984 | Hillis . | |
| 4,443,052 | 4/1984 | Eaby et al. . | |
| 4,620,759 | 11/1986 | Vetter . | |
| 4,666,325 | 5/1987 | Vantouroux | 439/680 X |
| 4,756,593 | 7/1988 | Koakutsu et al. | 439/680 X |
| 4,772,226 | 9/1988 | Schlesinger | 439/680 |
| 4,795,375 | 1/1989 | Williams | 439/680 |
| 4,820,204 | 4/1989 | Batty | 439/681 |
| 4,938,718 | 7/1990 | Guendel | 439/680 |
| 5,007,701 | 4/1991 | Roberts | 350/96.20 |
| 5,066,236 | 11/1991 | Broeksteeg | 439/79 |
| 5,149,283 | 9/1992 | Nakazawa | 439/680 X |

*Primary Examiner*—Khiem Nguyen
*Attorney, Agent, or Firm*—Bacon & Thomas

[57] ABSTRACT

A male and female connector contains a plurality of possible positions for key type projections and an equal number of receiving type features for accepting the key type projections. The features are arranged in nonsymmetrical but regularly spaced fashion, and the number of different combinations possible is given by the relationship $C=n!/r!(n-r)!$ where n is the total number of feature positions and r is the number of actual features provided.

15 Claims, 4 Drawing Sheets

FIG. 6
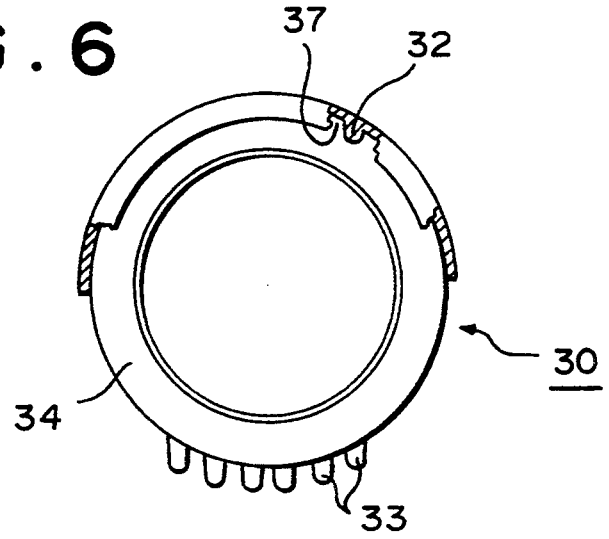
FIG. 7
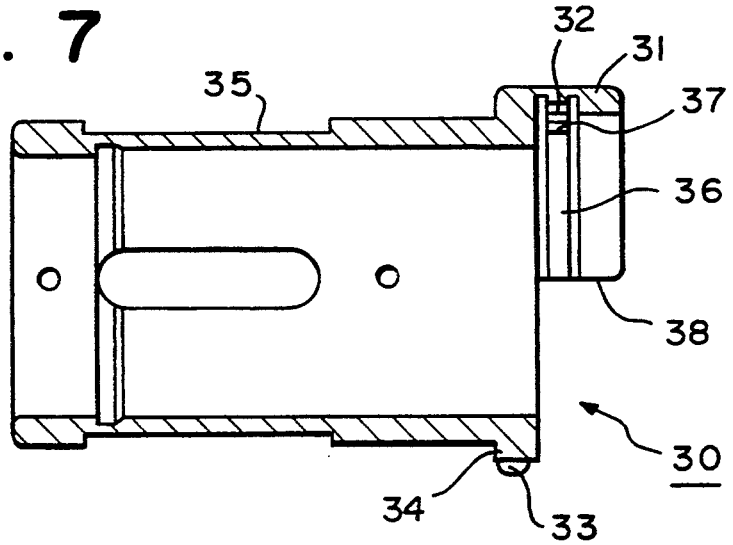
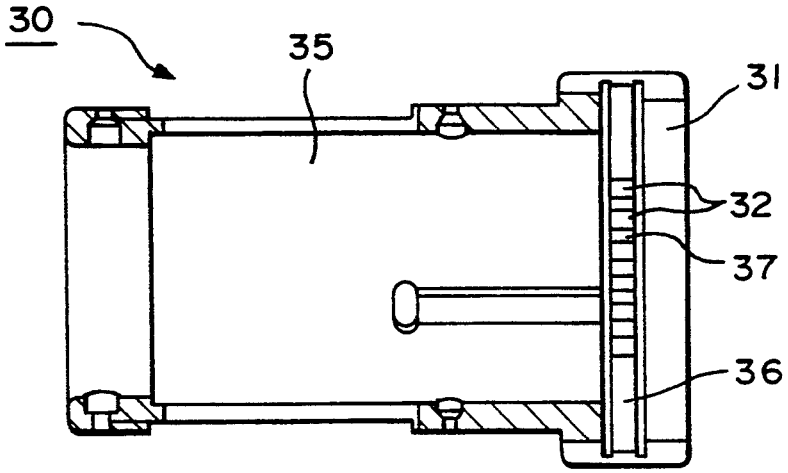
FIG. 8

CONNECTOR HAVING MULTIPLE KEYING FEATURES

BACKGROUND OF THE INVENTION

1. Field of the Invention

This invention relates to an arrangement of keying features for preventing unintentional coupling of otherwise complementary connectors.

2. Description of Related Art

In order to prevent unintentional connection of incompatible devices having the same type of connector, a variety of arrangements have been proposed for keying the connectors so that only connector parts with the same pattern of keying features can be mated together. The problem of mismating a plug component with the wrong receptacle component is particularly acute in aeronautical and aerospace installations where a large number of electrical connectors must frequently be coupled together in confined spaces. While a number of solutions to this problem have previously been proposed, the solutions have tended to be both unduly complex and costly, involving multiple parts or adapters in addition to the standard connector components to be mated. Also, the prior solutions have provided only a limited number of possible combinations, increasing the chance of mismating.

SUMMARY OF THE INVENTION

The present invention has as its principal objective the provision of a connector keying or indexing arrangement having a maximum number of possible key combinations, while eliminating the need for separate adapters or keying components by including the keying features directly on the connector components to be mated.

According to a preferred embodiment of the invention, the preferred keying arrangement takes the form of a plurality of projections and/or keyways on either a connector plug or the receptacle, and a plurality of cuts and/or holes in the corresponding receptacle or plug, the keying features being arranged in a regular spacing pattern, with each feature nevertheless being unique such that the total number of possible combinations of features is given by the formula $C=n!/r!(n-r)!$, where C is the number of unique combinations, n is the total number of possible features, and r is the number of actual features provided.

In an exemplary application of the preferred arrangement, the connector receptacle and plug are substantially cylindrical, the receptacle includes a lower flange extending axially forwardly of the connector and including a plurality of holes into which are fit corresponding projections on the plug, and the receptacle is provided with cuts in a top surface for engaging downwardly extending projections on a flange extending axially forwardly of the plug.

BRIEF DESCRIPTION OF THE DRAWINGS

FIG. 6 is a partially cross-sectional front view of a connector plug having keying feature complementary to those of the connector receptacle of FIGS. 1–5 and arranged in accordance with the principles of the preferred embodiment of the invention.

FIG. 7 is a cross-sectional side view of the connector plug of FIG. 6.

FIG. 8 is a cross-sectional bottom view of the connector plug of FIGS. 6 and 7.

DETAILED DESCRIPTION OF THE PREFERRED EMBODIMENTS

Figure 1:
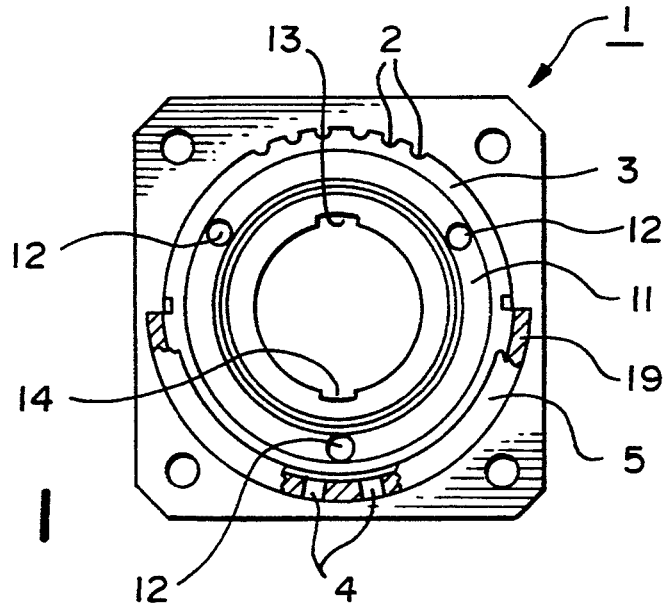
FIG. 1 is a front view of a connector receptacle having keying features arranged in accordance with the principles of a preferred embodiment of the invention.
Figure 2:
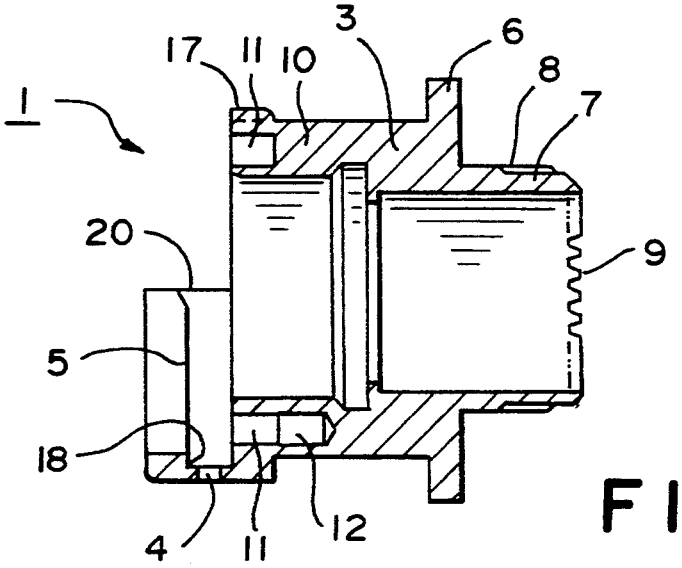
FIG. 2 is a cross-sectional side view of the connector receptacle of FIG. 1.
Figure 3:
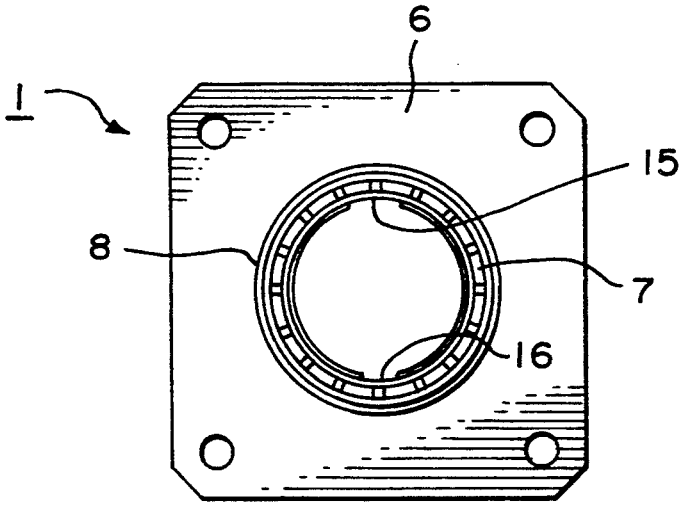
FIG. 3 is an elevated rear view of the connector receptacle of FIGS. 1 and 2.
Figure 4:
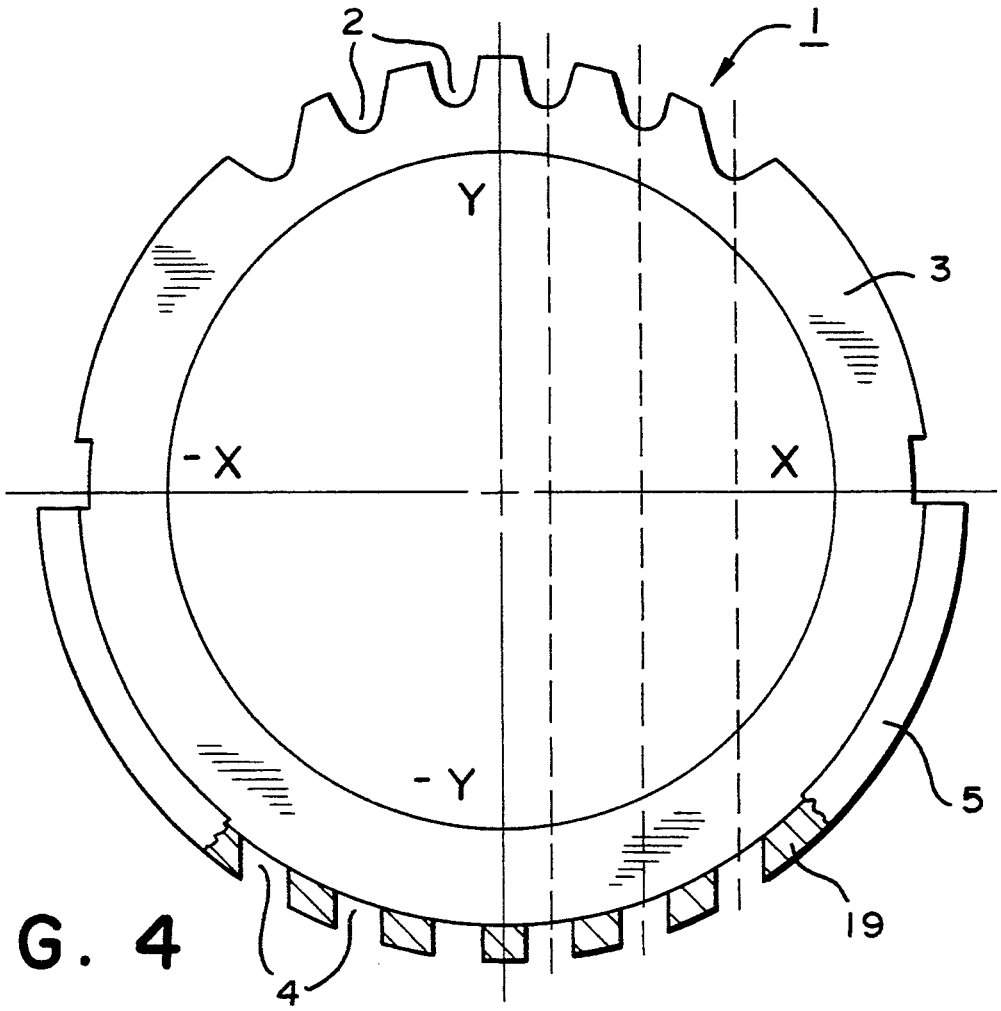
FIG. 4 is an enlarged partially cross-sectional front view of the connector receptacle shown in FIGS. 1–3.
Figure 5:
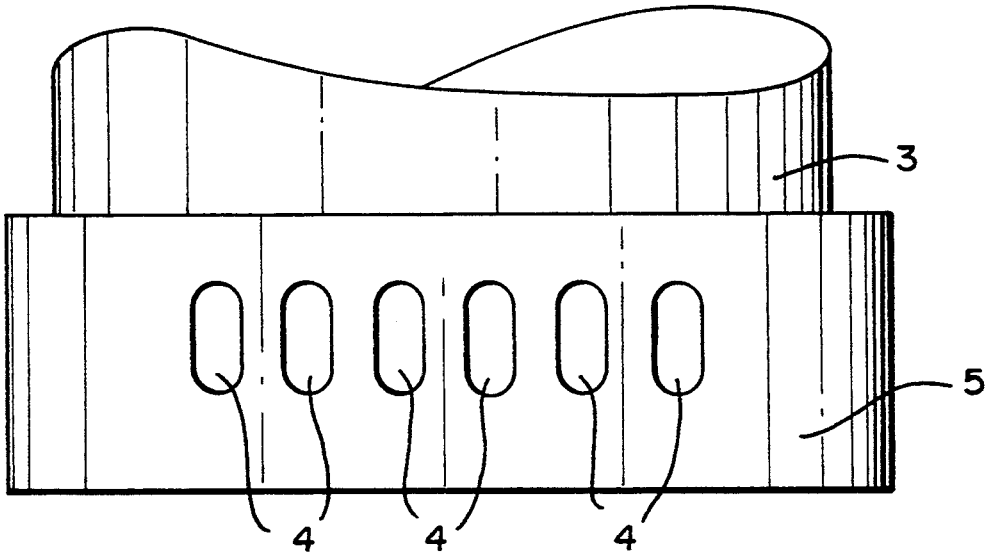
FIG. 5 is an elevated bottom view of the connector receptacle of FIGS. 1–4.
Figure 9:
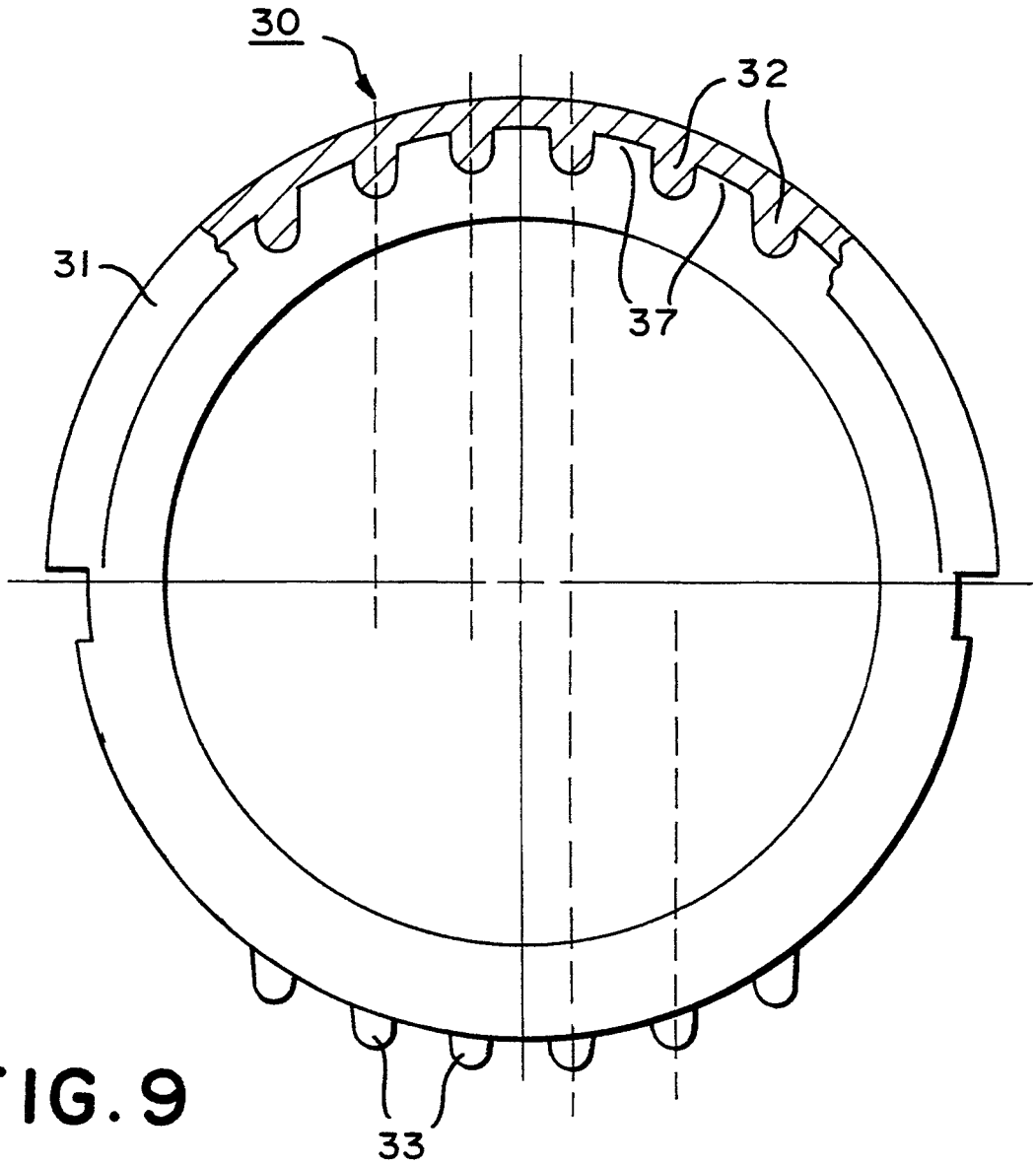
FIG. 9 is an enlarged partially cross-sectional front view of the connector plug of FIGS. 6–8.

FIGS. 1–10 show in detail a specific embodiment of the invention, but those skilled in the art will appreciate that the principles of the invention are applicable to a wide variety of different connector structures, including electrical as well as other types of connectors, and shapes other than cylindrical.

The basic principle of the invention is to provide a plurality of unique keying features, either in the form of cuts and complementary keys, or in the form of holes and projections, in a regular spaced pattern. Because each feature is unique, the formula $C=n!/r!(n-r)!$ applies, maximizing the number of possible combinations. Manufacture of the features is simplified by regularly spacing the features and by orienting the features parallel to a common axis. For example, in the illustrated arrangement, which contains at least 12 possible positions n of key type projections and 12 receiving type features, if one selects the number of actual features to be 3, 4, 5, or 6, the respective numbers of polarization probabilities are 220, 495, 792, and 924, which is far greater than the number achievable by previously proposed arrangements of comparable complexity.

Although coining is a preferred method of forming the keying features, it will be appreciated that the keys may be coined, machined, extruded, welded and/or soldered to a respective connector half, and that any description of particular construction methods is not intended to be limiting.

FIGS. 1–5 show a receptacle or socket 1 in which the keying features are in the form of slots 2 on the main body 3 of the receptacle and holes 4 on a flange 5 extending axially forwardly of main body 3.

Main body 3 is generally cylindrical in shape and includes a mounting flange 6 extending transversely relative to a longitudinal axis of the main body for mounting the receptacle to a panel. Main body 3 also includes a rear mating section 7 having a threaded portion 8 for receiving a plug connector mounting ring and a serrated interface 9. Front interface portion 10 includes a groove 11 for receiving docking and retaining rings (not shown), the groove having equidistant bores 12 in communication therewith for receiving compression springs (not shown). The manner in which the compression springs, docking ring, and retention ring cooperate during mating of a connector plug to the receptacle is known, for example from U.S. Pat. No. 3,629,791, and forms no part of the present invention.

The interior of the receptacle is designed to receive contact inserts (not shown) which are oriented by different size grooves 13–16 in an interior surface of a main body 3 as is shown, for example, from the above mentioned U.S. Pat. No. 3,629,791. At the front of main body 3 is an enlarged diameter portion or rim 17 at the top of which are provided the slots or grooves 2. Slots or grooves 2 preferably extend completely through the rim 17. Flange 5 extends forwardly from a bottom half of rim 17 and has a semi-circular cross-section when viewed from the front. Flange 5 includes on an inner surface, a groove 18 which forms a relatively thin portion 19. Holes 4 extend through portion 19.

The shape of slots 2 is such that an interfitting key can enter along a vertical axis perpendicular to the plane defined by the top surface 20 of flange 5. Thus, an angle of the slot relative to the vertical axis is preferably greater on the lower than on the upper side of the respective cut, the angle on the lower side increasing at positions away from the top of the connector and the angle on the lower side decreasing away from the top of the connector. Because the slots are oriented parallel to each other rather than radially, and at regular intervals, the slots are a symmetric relative to the longitudinal axis of the connector and the outer surface of the connector, and thus each key and slot combination is unique.

Holes 4 are elliptical in cross section when viewed from above or below and have a central axis which coincides with the vertical axes through the lowest point in slots 2. Thus, holes 4 are also regularly spaced and yet are also unique in that the angle of the hole relative to the surface through which it is cut is different for each hole.

Figure 10:
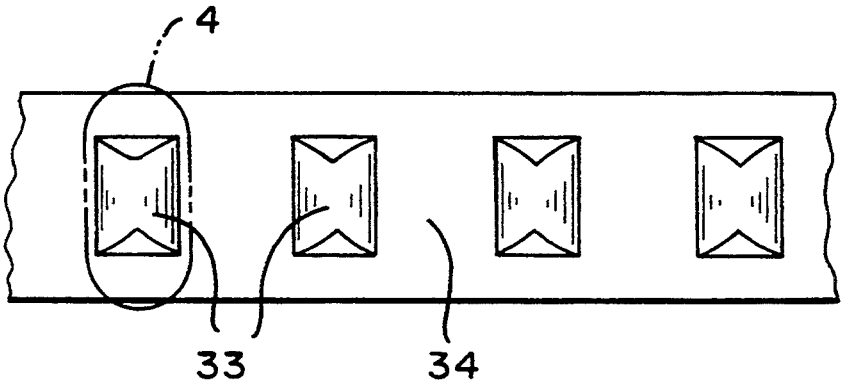
FIG. 10 is an elevated bottom view of the connector plug of FIGS. 6–9.

Turning to FIGS. 6–10, plug 30 also includes a flange 31 extending in the mating direction, from which projections 32 extend, and a plurality of projections 33 extending from a lower surface of a rim 34 provided on main body 35. Projections 32 and 33 are arranged to fit vertically into the corresponding slots and holes provided in the receptacle. Projections 32 are provided in a groove 36 and formed by coining the gaps 37 between the projection to the full width of the groove. Projections 33, which may be formed by machining, extend from the lower surface of rim 34 and are chamfered to facilitate entry into holes 4, as shown in FIG. 10. Preferably, the coining of projections 32 does not cause any protrusions on the exterior surface of the connector. Each of projections 32 and 33 has a central vertical axis parallel to the plane defined by the plane through surfaces 38 at which flanges 5 and 31 engage each other upon mating, with the axes intersecting the plane at equal intervals.

As with receptacle 1, plug 30 includes a contact insert (not shown), although it will be appreciated by those skilled in the art the illustrating connector keying arrangement is not limited to an electrical connector context and that the insert may contain optical fibers, hydraulic fittings, and so forth.

Although in the drawings, all features are depicted as being present, only a predetermined number are of the keys and an equal number of the slots or holes will actually be present, at different positions selected from the available positions and depicted in the drawings. It is contemplated that each combination will be given a unique number or other identifier which will be prominently displayed on the exterior of the respective connector parts. In general, the number of projections should equal the number of slots or holes, although a receptacle with the greater number of holes could be designed to accommodate more than one type of keying arrangement.

As will be apparent to those skilled in the art, when connecting the plug and receptacle together, a certain amount of play is necessary to permit the respective projections to fit over and be inserted vertically into the appropriate holes. When the projections fit within the respective slots and holes, a suitable coupling means such as the one shown from the above-mentioned U.S. Pat. No. 3,629,791 (not shown) may be used to secure the receptacle and plug together. Alteratively, the connector parts could be designed so that the features on one connector part fit axially rather than vertically into complementary features on the other connector part. It is therefore to be understood by those skilled in the art, as noted above, that the invention is not intended to be limited by the above illustrations or description, and consequently that the invention should be defined solely by the appended claims.

We claim:

1. A connector keying arrangement, comprising:

a first connector part having a central longitudinal axis and first and second axes perpendicular to the longitudinal axis and to each other;

a second connector part arranged to mate with the first connector part in a direction parallel to said first axis and perpendicular to said longitudinal axis and also having a central longitudinal axis and perpendicular first and second axes, said longitudinal axes of the first and second connector parts coinciding upon mating of the connector parts;

a plurality of first keying features on said first connector, said features having axes parallel to said first axis which intersect said second axis at selected first ones of a plurality of equally spaced positions on said first axis;

a plurality of complementary keying features on said second connector part, said complementary keying features having axes parallel to said first axis which intersect said second axis at selected second ones of a plurality of equally spaced positions on said first axis, wherein said first and complementary keying features are arranged to prevent mating of said connector parts unless said first and second selected ones of said positions are identical.

2. An arrangement as claimed in claim 1, wherein said keying features comprise a plurality of projections extending from said first connector part.

3. An arrangement as claimed in claim 2, wherein said first connector part includes a main body and a flange extending axially forwardly from the main body and wherein said plurality of projections extends inwardly from the flange, and said receiving features comprise slots in a main body of the second connector part.

4. A connector as claimed in claim 3, wherein a second plurality of projections extends from a main body of the first connector part and said second connector part includes a flange having holes therein for receiving said second projections.

5. A connector as claimed in claim 1, wherein a second plurality of projections extends from a main body of the first connector part and said second connector part includes a flange having holes therein for receiving said second projections.

6. An arrangement as claimed in claim 1, wherein said first and second connector parts are, respectively, an electrical connector plug and an electrical connector receptacle.

7. A connector keying arrangement, comprising:

a first connector part having perpendicular first and second axes;

a second connector part arranged to mate with the first connector part and also having perpendicular first and second axes;

a plurality of first keying features on said first connector, said features having axes parallel to said first axis which intersects at second axis at selected first ones of a plurality of equally spaced positions on said first axis;

a plurality of complementary keying features on said second connector part, said complementary keying features having axes parallel to said first axis which intersect at said second axis at selected second ones of a plurality of equally spaced positions on said first axis, wherein said first and complementary keying features are arranged to prevent mating of said connector parts unless said first and second selected ones of said positions are identical, wherein said first and second connector parts are substantially cylindrical, and wherein said first and complementary keying features are arranged around a circumference of said first and second connector parts.

8. A connector keying arrangement, comprising:

a first connector part having a longitudinal axis and first and second axes transverse to each other and to the longitudinal axis;

a second connector part having a longitudinal axis and first and second axes transverse to each other and to the longitudinal axis such that when said first and second parts are mated, said longitudinal axes coincide;

a plurality of projections on said first connector part;

a plurality of complementary projection-receiving features on said second connector part, wherein said projections are arranged to be received in said receiving features in a direction parallel to said first transverse axes, and to prevent mating of said first and second connector parts unless positions of said projections and key receiving features along said second transverse axis are identical.

9. An arrangement as claimed in claim 8, wherein said positions along said second axis are selected from among a plurality of equally spaced positions along said axis.

10. An arrangement as claimed in claim 8, wherein said keying features comprise a plurality of projections extending from said first connector part.

11. An arrangement as claimed in claim 10, wherein said first connector part includes a main body and a flange extending axially forwardly from the main body and wherein said plurality of projections extends inwardly from the flange, and said receiving features comprise slots in a main body of the second connector part.

12. A connector as claimed in claim 11, wherein a second plurality of projections extends from a main body of the first connector part and said second connector part includes a flange having holes therein for receiving said second projections.

13. A connector as claimed in claim 8, wherein a second plurality of projections extends from a main body of the first connector part and said second connector part includes a flange having holes therein for receiving said second projections.

14. An arrangement as claimed in claim 8, wherein said first and second connector parts are, respectively, an electrical connector plug and an electrical connector receptacle.

15. A connector as claimed in claim 8, wherein said first and second connector parts are substantially cylindrical.

* * * * *